US007955013B2

(12) United States Patent
Ortiz

(10) Patent No.: US 7,955,013 B2
(45) Date of Patent: Jun. 7, 2011

(54) MEDIA ENGAGING MEMBERS

(75) Inventor: Hugo S. Ortiz, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 643 days.

(21) Appl. No.: 11/553,668

(22) Filed: Oct. 27, 2006

(65) Prior Publication Data

US 2008/0145129 A1 Jun. 19, 2008

(51) Int. Cl.
*B65H 29/20* (2006.01)
*B41J 13/02* (2006.01)

(52) U.S. Cl. ..... 400/641; 400/636; 400/642

(58) Field of Classification Search ..... 400/636, 400/363, 625, 579, 585, 642, 315, 641, 624; 271/275, 314; *B65H 29/20; B41J 13/02*
See application file for complete search history.

(56) References Cited

U.S. PATENT DOCUMENTS 5,524,994 A 6/1996 Hirano
5,606,357 A * 2/1997 Bekki ..... 347/104
5,648,807 A 7/1997 Saito et al.
5,807,003 A 9/1998 Kobayashi et al.
5,961,234 A 10/1999 Uchikata
5,995,797 A 11/1999 Shigeta et al.
6,059,287 A * 5/2000 Bae ..... 271/315
6,276,680 B1 * 8/2001 Sonoda et al. ..... 271/273
6,325,560 B1 12/2001 Hirabayashi et al.
6,367,998 B1 4/2002 Lee
6,582,140 B2 6/2003 Kimura
7,287,922 B2 * 10/2007 Buxton et al. ..... 400/636
2001/0036381 A1 11/2001 Hirabayashi et al.
2002/0084580 A1 7/2002 Shiau

FOREIGN PATENT DOCUMENTS

JP 06328677 A * 11/1994
JP 2001080805 A * 3/2001
JP 2002241008 A * 8/2002
JP 2003145867 A * 5/2003

* cited by examiner

*Primary Examiner* — Judy Nguyen
*Assistant Examiner* — Jennifer Simmons

(57) ABSTRACT

Medium engaging members are rotatable about an axle. In one embodiment, the members have filed hubs asymmetrically extending towards one another. In another embodiment, the members have centers of mass such that the members lean into abutment with one another.

24 Claims, 4 Drawing Sheets

MEDIA ENGAGING MEMBERS

BACKGROUND

Media transport systems sometimes employ one or more idling media engaging members, such as star wheels or rollers, which exert a force upon a medium. Such members may cause undesirable marking upon the medium being engaged.

DETAILED DESCRIPTION OF THE EXAMPLE EMBODIMENTS

Figure 1:
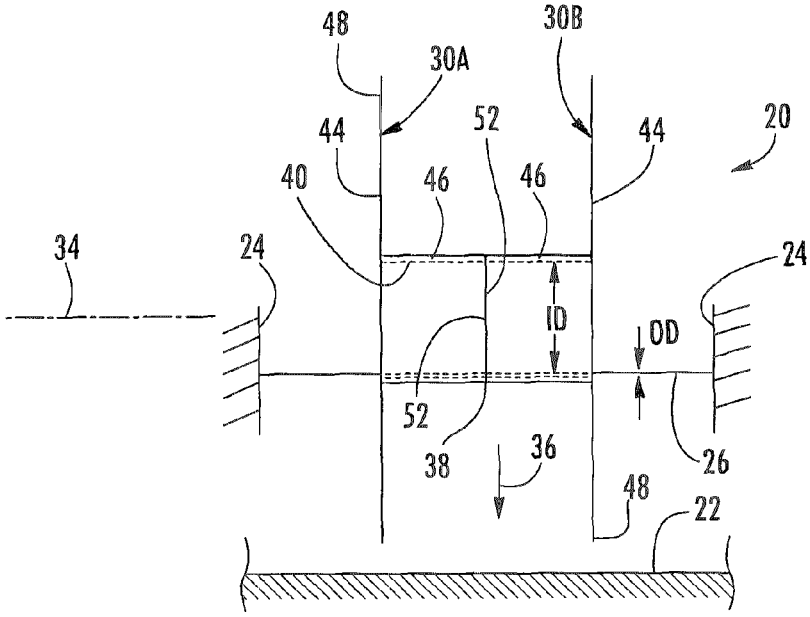
FIG. 1 is a schematic illustration of a media transport system according to an example embodiment.

FIG. 1 schematically illustrates media transport system 20 according to an example embodiment. Media transport system 20 is configured to assist in moving a medium, such as a sheet of paper or other material. As will be described in more detail hereafter, in one embodiment, media transport system 20 is incorporated into a printer or other imaging device to assist in moving a printed upon medium through the printer. Media transport system 20 provides a low-cost system for assisting in moving a medium while reducing marks upon the medium.

Media transport system 20 includes a base surface 22, supports 24, axle 26 and media engaging members 30A and 30B (collectively referred to as media engaging members 30). Base surface 22 comprises a surface located so as to support a medium, such as a sheet, against members 30. In one embodiment, surface 22 is at least partially opposite to members 30. In one embodiment, surface 22 may be provided by one or more stationary or rigid structures such as a platen. In another embodiment, surface 22 may be provided by one or more rollers. In yet another embodiment, surface 22 may be provided by one or more belts.

Supports 24 comprise one or more structures configured to support axle 26 relative to surface 22. Although system 20 is illustrated as including two opposite supports 24 supporting opposite ends of axle 26, in other embodiments, a greater or fewer number of such supports 24 may be used. Supports 24 may have a variety of configurations. In one embodiment in which axle 26 is resilient, supports 24 may be rigid or stationary. In another embodiment in which axle 26 is rigid or stationary, supports 24 may be resilient in nature so as to resiliently flex or move towards and away from surface 22.

Axle 26 comprises one or more structures configured to rotationally support members 30 such that members 30 rotate relative to and about axle 26 about an axis 34 that extends through a radial center point of members 30. In one embodiment, axis 34 is offset from the axis of axle 26 by the difference between the outer diameter of axle 26 and the inner diameter of member 30. Axle 26 is further configured to engage members 30 so as to apply a bias force in a direction indicated by arrow 36 that is substantially perpendicular to axis 34. In addition, axle 26 is configured to permit members 30 to tilt, lean or pivot about an axis 38 (into the page) or an axis parallel to axis 38 that is substantially perpendicular to both axis 34 and arrow 36. According to one embodiment, axle 26 is resiliently flexible, permitting axle 26 to resiliently flex in a direction opposite to arrow 36. In other embodiments, axle 26 may be inflexible, wherein support 24 are movable towards and away from surface 22 and are resiliently biased toward surface 22.

According to one embodiment, axle 26 comprises a coil spring extending along an axis 34 and supported at opposite ends by supports 24. According to another embodiment, axle 26 comprises a resiliently flexible line of one or more materials, such as a wire or string, secured to supports 24 at opposite ends. For example, one of embodiment, axle 26 may comprise a resiliently flexible wire supported in a taut condition by supports 24. In another embodiment, axle 26 may comprise a resiliently flexible band or string of one of more materials supported in a taut condition by supports 24. Whether a coil spring or a line, axle 26 is provided with an outer diameter less than an inner diameter of a bore or other passage in member 30 through which axle 26 extends, permitting members 30 to pivot, tilt or lean about axes that are parallel to axis 38.

Members 30 comprise structures configured to engage a medium, such as a sheet of paper or other material or materials, so as to transfer a force to the medium in the direction indicated by arrow 36 while rotating about axis 34 and about axle 26. Members 30 are each further configured to have an interior bore, opening or other passage 40 through which axle 26 extends, wherein the passage has an inner diameter or corresponding dimension greater than the outer diameter of axle 26. As a result, less surface area of members 30 are in contact with surfaces of axle 26, reducing friction and drag upon members 30 by axle 26. By experiencing less drag and friction with axle 26, members 30 are able to more freely rotate about axle 26 and are less likely to form marks upon an engaged medium. In one embodiment, passage 40 has an inner diameter ID at least 1.36 times greater than outer diameter OD of axle 26. In another embodiment, passage 40 has an inner diameter ID at least 4.5 times the outer diameter OD of axle 26.

According to one example embodiment, members 30 are each asymmetric. For purposes of this disclosure, the term "asymmetric" when applied to a media engaging member shall mean that the member lacks symmetry with respect to a plane that is perpendicular to an axis of rotation of the media engaging member and intersects those portions of the member that physically contact the media. In the example illustrated, member 30 is asymmetric so as to have a center of mass to one side of a plane that is perpendicular to an axis of rotation of the media engaging member and intersects those portions of the member that physically contact the media. As a result, this asymmetry causes members 30 to tilt, lean or pivot about one of more axes parallel to axis 38 such that members 30 lean or abut against one another. In particular, the asymmetric configuration of members 30 results in members 30 having a lower energy state when tilted in the direction of the hub. Consequently, even when members 30 are initially tilted away from their center of masses (for example, away from an asymmetrically extending hub), normal forces imposed upon members 30 by axle 26 cause members 30 to pivot toward the lower energy state in which members 30 tilt toward the hub. Thereafter, members 30 move along the axle in the direction of the tilt and towards one another. As a result, members 30 prop against one another to self align with one another. In one embodiment, members 30 are configured so as to be asymmetric along axis 34 so as to tilt towards one another.

In the example embodiment shown, each member 30 comprises a spur or star, roller or wheel including a media engaging portion, referred to as a blade 44, and a hub 46. Blade 44 is a generally circular thin structure outwardly extending from hub 46 and terminating at an outer circumferential edge 48 having multiple circumstantially spaced tips, points or teeth configured to contact and grip or engage the medium while contacting a relatively small surface area of the medium.

Hub 46 asymmetrically extends from blade 44 and provides passage 40. Hub 46 is generally centered along a radial center of blade 44. Hub 46 terminates at an axial face 52. In one embodiment, face 52 extends in a plane substantially perpendicular to axis 34. In one embodiment, hub 46 extends substantially to one side of blade 44. As shown by FIG. 1, members 30A and 30B are substantially identical to one another and are arranged upon axle 26 such that hubs 46 project from corresponding blades 44 towards one another. Because hubs 46 asymmetrically extend from blades 44, hubs 46 tilt or pivot towards one another. In particular, hub 46 of member 30A pivots in a clockwise direction and hub 46 of member 30B pivots in a counter-clockwise direction (as seen in FIG. 1). Such pivoting is inhibited as a result of inter-engagement between hubs 46. During such inter-engagement, faces 52 abut one another and align members 30 with one another to assist in maintaining blades 44 substantially perpendicular to axis 34. In yet other embodiments, members 30 may have other configurations.

Figure 2:
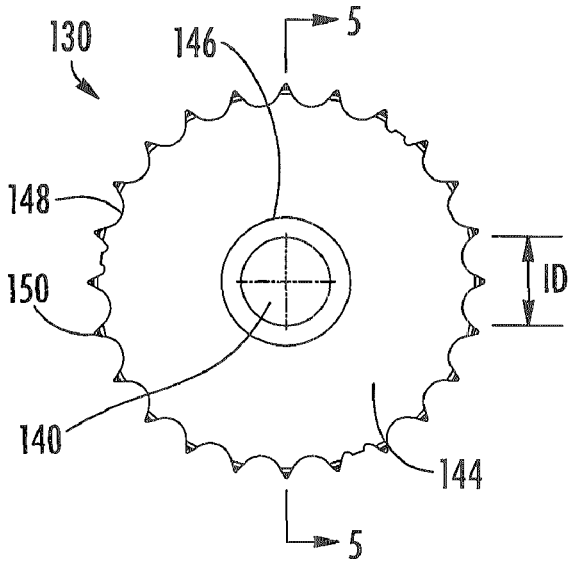
FIG. 2 is a front plan view of a media engaging member of the media transport system of FIG. 1 according to an example embodiment.
Figure 3:
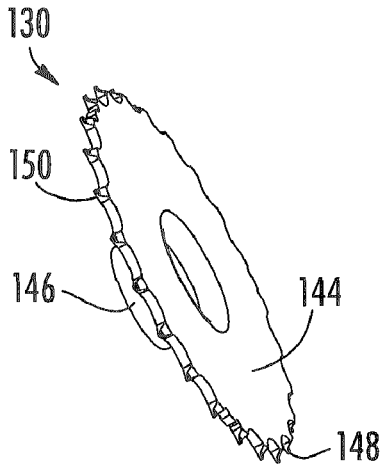
FIG. 3 is a rear perspective view of the media engaging member of FIG. 2 according to an example embodiment.
Figure 4:
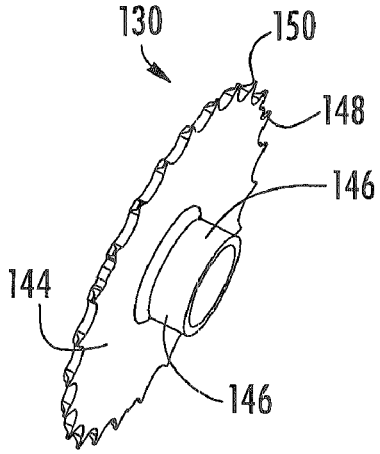
FIG. 4 is a front perspective view of the media engaging member of FIG. 2 according to an example embodiment.
Figure 5:
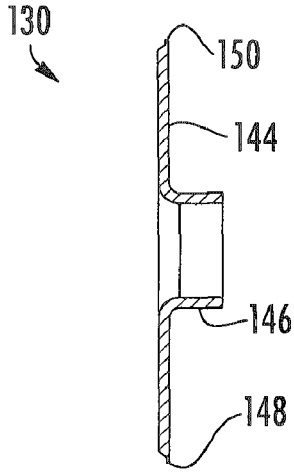
FIG. 5 is a sectional view of the media engaging member of FIG. 2 taken a long line 5-5 of FIG. 2 according to an example embodiment.

FIGS. 2-4 illustrate media engaging member 130, a particular embodiment of media engaging member 30 shown in FIG. 1. In the example illustrated, media engaging member 130 is integrally formed as a single unitary body from one or more materials. In the example illustrated, media engaging member 130 is integrally formed as a single unitary body from sheet-metal. For example, in one of embodiment, member 130 is formed from 0.2 mm sheet-metal. According to one embodiment, member 30 is formed by stamping and forming sheet-metal. In other embodiments, member 130 may be formed from other materials and may be formed in other fashions. For example, member 130 may alternatively be formed by molding one or more polymer materials, by growing one or more silicon materials or by stamping and deforming one or more other materials. In yet another embodiment, member 130 may be formed from multiple parts or portions which are fastened, bonded, welded or otherwise joined to one another.

As shown by FIGS. 2-4, member 130 includes blade 144 and hub 146. Blade 144 comprises a relatively thin layer or layers of one or more materials radially extending outward from hub 146 and terminating along a circumferential edge 148 having points 150. Hub 146 axially extends from one side of blade 144 such that hub 146 asymmetrically extends to one side of blade 144. Hub 146 provides a passage 140 through which an axle, such as axle 26 schematically shown in FIG. 1, extends. Like hub 46, hub 146 of member 130 has an inner diameter substantially larger than the outer diameter of the axle extending through passage 140. As a result, member 130 experiences less friction and less drag while rotating about axle 26. At the same time, member 130 self aligns with an opposite member 130 along the axle 26 by tilting or leaning into abutment with the other member 130.

Figure 6:
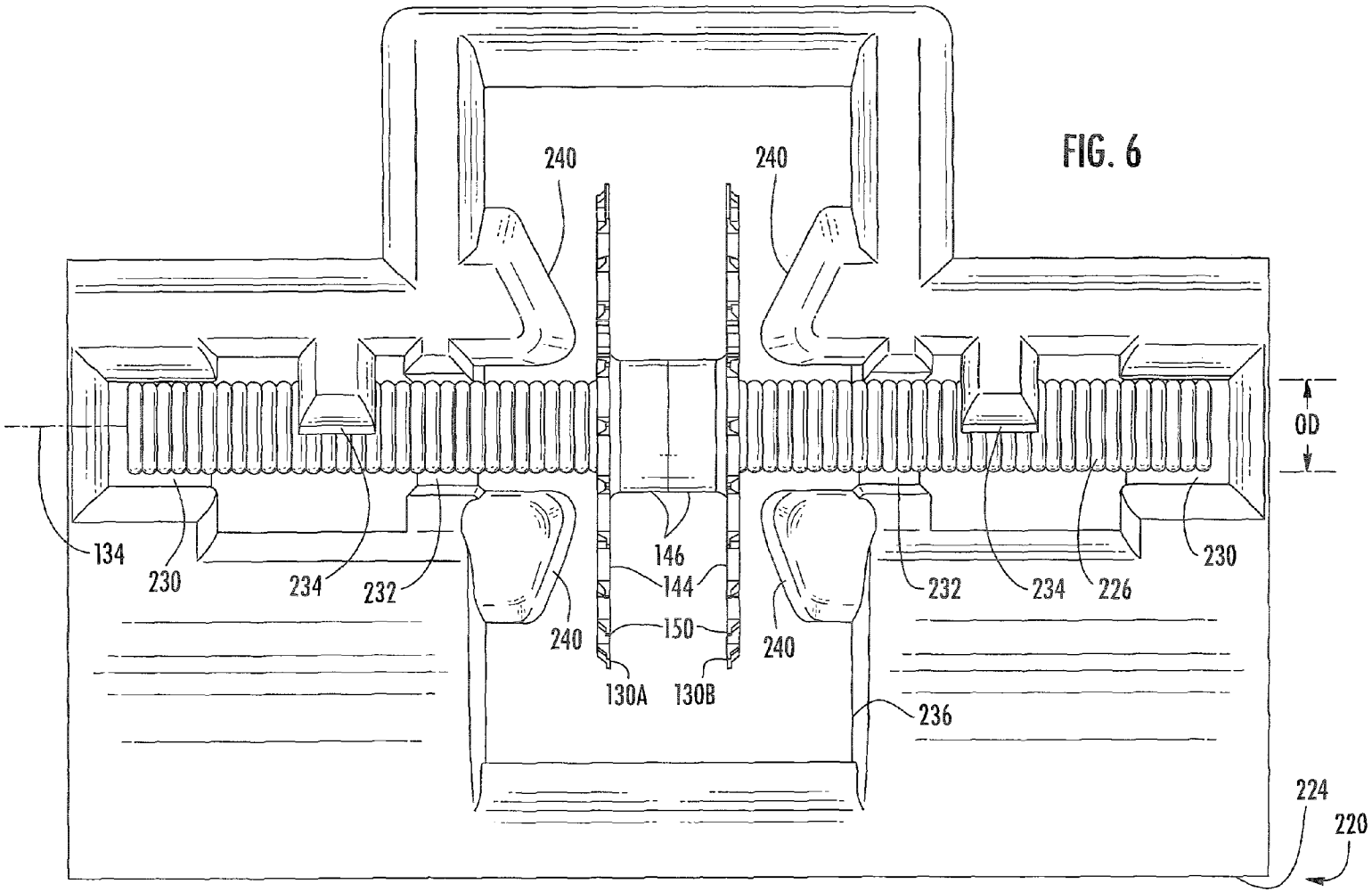
FIG. 6 is a top plan view of another embodiment of the media transport system of FIG. 1 according to an example embodiment.

FIG. 6 illustrates media transport system 220, a particular embodiment of media transport system 20. Like media transport system 20, media transport system 220 is configured to assist in moving a printed upon medium through the printer. Media transport system 220 provides a low-cost system for assisting in moving a medium while reducing marks upon the medium. Media transport system 220 includes base surface 22 (shown in FIG. 1), support 224, axle 226 and media engaging members 130A and 130B (collectively referred to as media engaging members 130) as described above with respect to FIGS. 2-5.

Support 224 comprises a structure configured to support and retain opposite ends of axle 226 relative to a base surface 22 (shown in FIG. 1). In the example illustrated, support 224 is integrally formed as a single unitary body from one or more polymeric materials. In other embodiments, support 224 may be formed from other materials and may be formed from multiple parts or portions which are joined to one another. Support 224 includes end support surfaces 230, intermediate support surfaces 232, opposing support surfaces 234, pocket 236 and axial guides 240. End support surfaces 230, 232 comprise spaced surfaces configured to limit travel of the deflection along axis 36. Intermediate surfaces 234 comprise surfaces located between surfaces 230 and 232 and configured to engage an opposite side of axle 226. Surfaces 230, 232 and 234 cooperate with one another to releasably and removably capture axle 226 therebetween. As a result, axle 226 and members 130 are more easily assembled and connected to support 224 without tools. Likewise, axle 226 and members 130 may be more easily removed from support 224 for repair or replacement. In other embodiments, other arrangements may be utilized to releasably secure axle 226 to support 224 or to fixedly connect axle 226 to support 224.

Pocket 236 comprises a cavity or opening in which members 130 are located and rotate about axle 226. Axial guides 240 comprise structures projecting from a remainder of support 224 that are configured to limit axial movement of members 130 along axis 134 of axle 226. In other embodiments, guides 240 may be omitted. In yet other embodiments, support 224 may have other sizes, shapes and configurations.

Axle 226 extends along axis 134 and rotationally supports members 130. Axle 226 has an outer diameter OD substantially less than the inner diameter ID (shown in FIG. 2) of hub 146 of member 130. In one embodiment, hub 146 has an inner diameter ID at least 1.36 times greater than outer diameter OD of axle 226. In one embodiment, passage 140 has an inner diameter ID at least 4.5 times the outer diameter OD of axle 226. As a result, members 130 experience less friction and less drag while rotating about axle 226. At the same time, members 130 self align with one another along the axle 226 by tilting or leaning into abutment with each other.

In the example illustrated, axle 226 comprises a coil spring. As a result, axle 226 is flexible and is resilient so as to resiliently support members 130 opposite a medium on an opposite side of the medium as surface 22 (shown in FIG. 1). At the same time, axle 226 has a sufficient degree of inflexibility or rigidity so as to be held and captured between surfaces 230, 232 and 234 of support 224, facilitating assembly. In other embodiments, axle 226 may comprise other structures having other configurations.

According to one example embodiment, axle 226 comprises a closed coil spring formed having a spring constant of about 0.12 N/mm, having a length of about 18 mm and an outer diameter of about 1.3 mm. Members 130 each have a blade 144 with an outer diameter of about 7.5 mm, with points 150 having a pitch of 15 deg. Hub 146 has an inner diameter of about 1.8 mm, an outer diameter of about 2.2 mm, and axially projects from a closest face of blade 144 by a distance of about 1 mm.

According to another example embodiment, axle 226 may be replaced with a metallic wire such as a piano wire commercially available from McMaster Can and having an outer diameter of about 0.2 mm. In such an embodiment, axle 226 has opposite ends affixed or retained by support 224 such that axle 226 is held taut by support 224. In other embodiments, the piano wire itself can be used as a resilient axle.

Figure 7:
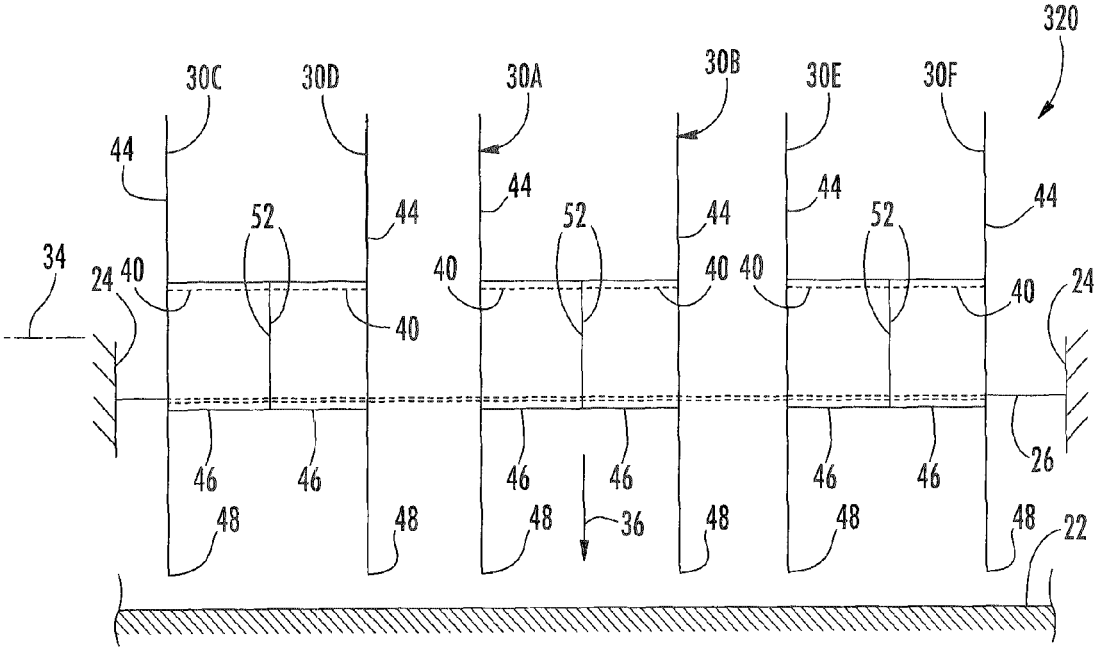
FIG. 7 is a schematic illustration of another embodiment of the media transport system of FIG. 1 according to an example embodiment.

FIG. 7 schematically illustrates media transport system 320, another embodiment of media transport system 20. Media transport system 320 is similar to media transport system 20 except that media transport system 320 additionally includes media engaging members 30C, 30D, 30E and 30F. Each of media engaging members 30C-30F is substantially identical to media engaging members 30A and 30B. Like media engaging members 30A and 30B, media engaging members 30C-30F are rotationally supported by axle 26 which passes through the passage 40 of each media engaging member 30. Like media engaging members 30A and 30B, media engaging members 30C-30F rotate about and relative to axle 26 about an axis 34 which extends through radial center points of each of members 30 such that media engaging members 30 apply a force in the direction indicated by arrow 36 to a medium (not shown). In the particular example illustrated, each of media engaging members 30 comprise star wheels. In other embodiments, each of media engaging members 30 shown in FIG. 7 may comprise other media engaging members configured to engage a medium while rotating relatives to and about axle 26.

As shown by FIG. 7, media engaging members 30C-30F are arranged on axle 26 in pairs similar to media engaging members 30A and 30B. In particular, media engaging members 30C and 30D are paired opposite one another on axle 26 while media engaging members 30E and 30F are paired opposite one another on axle 26. As a result, media engaging members 30C and 30D have a tendency to pivot towards one another such that their opposing faces 52 of hubs 46 abut one another to facilitate self alignment of media engaging members 30C and 30D with respect to one another. Media engaging members 30E and 30F are arranged on axle 26 and self align with respect to one another in a similar fashion.

Because media transport system 320 includes multiple pairs of opposing media engaging members 30 along axle 26, normal forces applied to a medium by edges 48 of media engaging members 30 may be more uniformly distributed across a face of a medium. As a result, there may be a reduced likelihood of marking by edges 48 upon the medium. Although media transport system 320 is illustrated as including three opposing pairs of members 30, in other embodiments, media transport system 320 may alternatively include two opposing pairs or greater than three opposing pairs of media engaging members 30.

Figure 8:
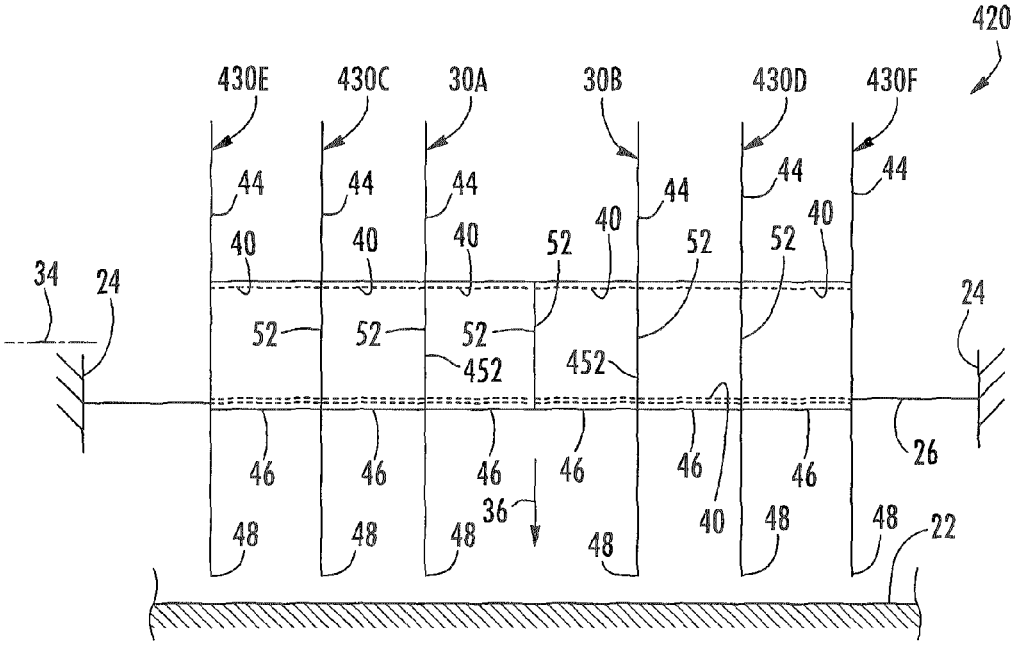
FIG. 8 is a schematic illustration of another embodiment of the media transport system of FIG. 1 according to an example embodiment.

FIG. 8 schematically illustrates media transport system 420, another embodiment of media transport system 20. Media transport system 420 is similar to media transport system 20 except that media transport system 420 additionally includes media engaging members 430C, 430D, 430E and 430F (collectively referred to as media engaging members 430). Those remaining components of media transport system 420 which correspond to components of media transport system 20 are numbered similarly. Each of media engaging members for 430C-430F is substantial identical to media engaging members 30. Like media engaging members 30, each of media engaging members 430 is rotationally supported by axle 26 such that media engaging members 430 apply a force in the direction indicated by arrow 36 to a medium (not shown) and such that media engaging members 430 rotate relative to and about axle 26 about axis 34 which passes through a radial center point of each of members 30 and 430. In the particular example illustrated, each of media engaging members 30 and 430 comprise star wheels. In other embodiments, each of media engaging members 30 and 430 shown in FIG. 8 may comprise other media engaging members configured to engage a medium while rotating relative to and about axle 26.

As shown by FIG. 8, media engaging members 430 are arranged on axle 26 in a stacked fashion with respect to the opposing pair of media engaging members 30A and 30B. In particular, media engaging members 430C and 430D are stacked on opposite sides of media engaging members 30, sandwiching media engaging members 30 therebetween. The asymmetrically extending hubs 46 of media engaging members 430C and 430D project or extend towards one another. As a result, media engaging members 430C and 430D have a tendency to pivot towards one another such that the faces 52 of their hubs 46 abut against faces 452 of blades 44 of media engaging members 30. In particular, face 52 of hub 46 of media engaging member 430C abuts against face 452 of blade 44 of media engaging member 30A. Likewise, face 52 of hub 46 of media engaging member 430D abuts face 452 of blade 44 of media engaging member 30B. As a result, this symmetric or balanced arrangement of media engaging members 430 sandwiching media engaging members 30 facilitates self alignment of media engaging members 430C and 430D with respect to media engaging members 30 and with respect to one another. Media engaging members 430E and 430F are arranged on axle 26 and are stacked against opposite sides of media engaging members 430C and 430D, respectively, in a similar fashion so as to self align with respect to one another in a similar fashion.

Because media transport system 420 includes multiple stacked media engaging members 430 along axle 26, normal forces applied to a medium in the direction indicated by arrow 36 by edges 48 of media engaging members 30 and 430 may be more uniformly distributed across a face of a medium. As a result, there may be a reduced likelihood of marking by edges 48 upon the medium. Although media transport system 420 is illustrated as including two stacked members 430 on each side of media engaging members 30, in other embodiments, media transport system 420 may alternatively include a single pair of media engaging members 430 sandwiching media engaging members 30 or greater than two media engaging members 430 on each side of media engaging members 30.

Figure 9:
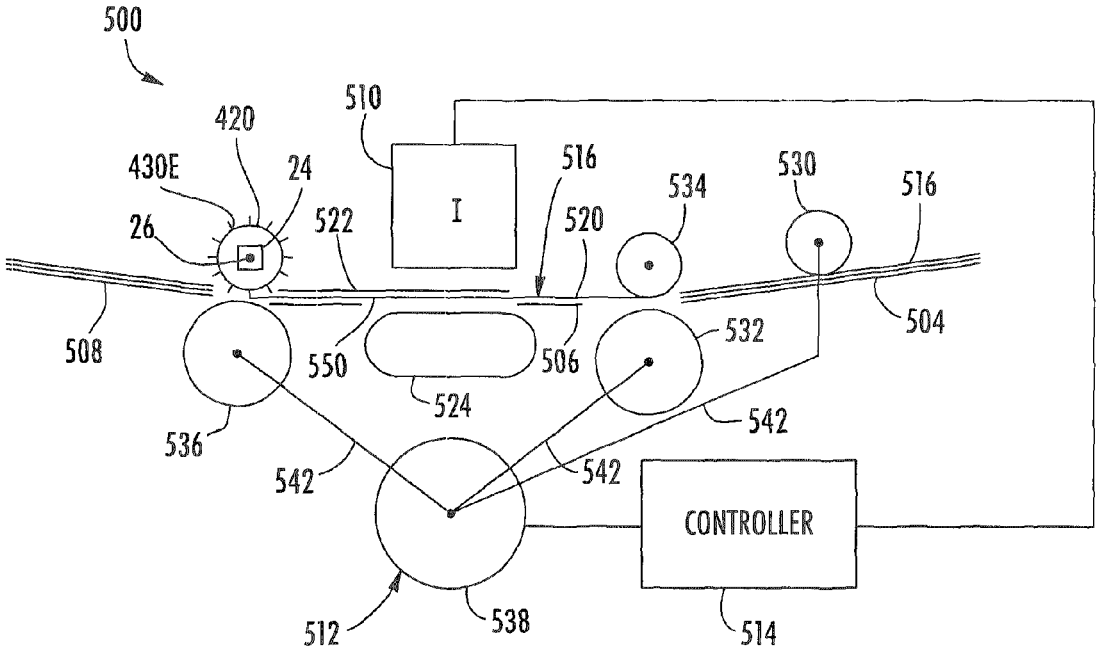
FIG. 9 is a schematic illustration of a printing system according to an example embodiment.

FIG. 9 schematically illustrates imaging or printing system 500, one example of a printing system incorporating a media transport system such as described with respect to FIGS. 1-8. In the particular example illustrated, printing system 500 incorporates media transport system 420. In other embodiments, printing system 500 may alternatively or additionally incorporate media transport system 20, media transport system 220 or media transport system 320. Because printing system 500 incorporates media transport system 420 (or alternatively media transport system 20, system 220 or system 320), sheets of media may be printed upon and transported through printing system 500 with a reduced likelihood of being marked or damaged.

Printing system 500 includes media input 504, platen or support 506, media output 508, imager 510, media drive 512 and controller 514. Media input 504 comprises one or more structures configured to store and supply sheets 516 of a medium, such a sheets of paper, to a remainder of printing system 500. In one embodiment, media input 504 is configured to store a stack of such sheets 516. In one embodiment, media input 504 may comprise a tray, a bin or other media loading device.

Support 506 comprises one or more structures configured to support and guide movement of sheets 516 from input 504 to output 508 generally across imager 510. Support 506 at least partially forms a media feed path extending from input 504 to output 508. Although the media path is illustrated as substantially linear, the media path and support 506 may alternatively be curved, serpentine or combinations of linear, curved and serpentine portions. In one embodiment, support 506 may include a cylinder or drum configured to support one or more sheets 516 of a medium during printing upon the medium.

Media output 508 comprises one or more structures configured to provide a recipient with access to printed upon sheets with 516 discharged from printing system 500. In one embodiment, media output 508 may comprise an output tray or an output bin. In yet other embodiments, media output 508 may alternatively be configured to redirect printed upon sheets 516 to one or more of finishing devices such as a duplexer, a collator, a stapler, a binder or a folder (not shown), provided in a separate device or also incorporated as part of printing system 500.

Imager 510 comprises a device configured to form an image upon a face, such as face 520 of the sheet 516. In one embodiment, imager 510 is configured to deposit one or more printing materials, such as toner or ink, upon face 520 to form the image. The deposited printing materials forms one or more layers 522 (schematically illustrated and enlarged for purposes of illustration) upon face 520. In one embodiment, imager 510 comprises one or more inkjet, drop-on-demand print heads configured to deposit fluid ink upon face 520. According to one particular embodiment, imager 510 is configured to deposit ink or other printing material substantially or completely from a first edge of sheet 516 to a second opposite edge of 516 for substantially borderless printing. For example, such borderless printing may be applied to photo media for printing photographs. In embodiments where imager 510 comprises an inkjet drop-on-demand printing device, printing system 500 may additionally include an ink capture device 524 opposite to imager 510. Ink capture device of 524 catches ink overspray along those edges of sheet 516 to which is applied the borderless printing. In one embodiment, ink capture device 524 may comprise a basin for collecting captured ink. In some embodiments, ink capture device 524 may additionally include an absorptive member for absorbing and retaining such captured ink. In other embodiments, imager 510 may comprise an electrophotographic printing or imaging device.

Media Drive 512 comprises an arrangement of components configured to facilitate movement of sheets 516 from media input 504 along the media path provided by support 506 across imager 510 media output 508. In addition to media transport system 420, media drive 512 includes pick roller 530, feed roller 532, idler roller 534, discharge roller 536 and actuator 538. Pick roller 530 comprises one or more rollers in frictional engagement with face 520 of a topmost sheet 516 within media input 504. Upon being driven, pick roller 530 moves a topmost sheet 516 from media input 504 toward support 506 and towards media feed roller 532.

Media feed roller 532 comprises one or more rollers across face 520 of sheet 516 substantially opposite to idler roller 534. Idler roller 534 comprises one or more idling rollers configured to cooperate with roller 532 to form a nip therebetween. Upon being driven, media feed roller 532 drives the sheet 516 to a position opposite to imager 510 and towards media discharge roller 536.

Media discharge roller 536 comprises one or more rollers at least partially opposite to media engaging members 430 (of which media engaging member 430E is shown in FIG. 9). Media discharge roller 536 provides base surface 22 (shown in FIG. 8) for media transport system 420. In other embodiments, base surface 22 may be provided by other structures, such as by support 506. Upon being driven, media discharge roller 536 cooperates with media transport system 420 to engage and move a printed upon sheet 516 to output 508.

Actuator 538 comprises one or more actuation devices, such as one or more motors, operably coupled to rollers 530, 532 and 536 by one or more drive trains or transmissions 542 (schematically shown). Actuator 538 is configured to selectively drive rollers 530, 532 and 536 to appropriately move sheets 516 through printing system 500.

Controller 514 comprises one or more processing units configured to generate control signals directing actuator 538 and transmissions 542 to selectively drive rollers and 530, 532 and 536. Controller 514 further generates control signals directing operation of imager 510 based upon an image (text, graphics, photos and the like) to be printed upon each of sheets 516. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 514 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, controller 514 generates control signals directing actuator 538 to appropriately power or drive components of media drive 512 to move a sheet 516 from media input 504 to a location opposite to imager 510. Such control signals may result in adjustment of power being supplied by actuator 538 or may result in the actuation of one or more clutching devices by one or more separate actuators, such as solenoids (not shown) provided as part of transmissions 542. Controller 514 further generates control signals directing imager 510 to deposit one or more layers 522 of printing material upon face 520 of the sheet 516 being printed upon. In one embodiment, imager 510 deposits such printing material from one edge to an opposite edge for borderless printing.

Controller 514 further generates control signals directing actuator 538 to power roller 536 which cooperates with media engaging members 430 of media transport system 420 to discharge the printed upon sheet to output 508. As roller 536 engages a back face 550 of the sheet being printed upon, media engaging members 430 engage printed upon face 520 of the same sheet 516. In particular, media engaging members 430 engage layers 522 of printing material upon face 520. However, because media transport system 420 reduces frictional drag upon each of members 430 as they rotate about axle 26, media engaging members 430 more freely rotate, reducing the likelihood of such rotation being impeded which may cause marks upon layers 522 of sheet 516. Consequently, the printed image quality of printing system 500 is enhanced.

Although media drive 512 is schematically illustrated as including rollers 530, 532 and 536, in other embodiments, media drive 512 may include a greater number of rollers sequentially located between media input 504 in media output 508. Although media drive 512 is schematically illustrated as including rollers 530, 532 and 536, such rollers may alternatively be replaced with other media engaging driving members such as belts and the like. Although printing system 500 is illustrated as including a single media transport system 420, in other embodiments, printing system 500 may include additional media transport systems.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

an axle;

a first member configured to engage a medium and rotate abut the axle, the first member having a first hub; and a second member configured to engage the medium and rotate about the axle, the second member having a second hub, the first hub and the second hub asymmetrically extending towards one another, wherein the first hub has a smallest interior diameter and wherein the axle has an outer diameter at least 25% less than the smallest interior diameter.

2. The apparatus of claim 1, wherein the first member and the second member each comprise a star wheel.

3. The apparatus of claim 2, wherein the star wheel is wholly formed from sheet metal.

4. The apparatus of claim 2, wherein the star wheel is integrally formed as a single unitary body.

5. The apparatus of claim 1, wherein the axle is a coil spring.

6. The apparatus of claim 1, wherein the axle is a resilient line of one or more materials.

7. The apparatus of claim 1, wherein the first hub has a smallest interior diameter at least 1.36 times an outer diameter of the axle.

8. The apparatus of claim 1 further comprising:

a third member configured to engage the medium and rotatable about the axle, the third member having a third hub; and a fourth member configured to engage the medium and rotatable about the axle, the fourth member having a fourth hub, the third hub and the fourth hub asymmetrically extending towards one another.

9. The apparatus of claim 1 further comprising:

a third member configured to engage the medium and rotatable about the axle, the third member having a third hub asymmetrically extending towards the first member; and a fourth member configured to engage the medium and rotatable about the axle, the fourth member having a fourth hub asymmetrically extending towards the second member, wherein the first member and the second member are sandwiched between the third member and a fourth member.

10. The apparatus of claim 9, wherein the third hub abuts the first member and the fourth hub abuts the second member.

11. The apparatus of claim 1 further comprising a holder supporting the axle.

12. The apparatus of claim 1 further comprising an imaging device configured to form one or more image layers on a face of the medium, wherein the first member and the second member are supported so as to engage the one or more image layers on the medium.

13. The apparatus of claim 12, wherein the imaging device is configured to deposit ink on the medium to form the one or more image layers.

14. The apparatus of claim 12, wherein the imaging device is configured such that the one or more image layers extend edge-to-edge across the medium.

15. In the apparatus of claim 1, wherein the first hub and the second hub abut one another.

16. The apparatus of claim 1, wherein the first member and the second member are movable relative to one another.

17. The apparatus of claim 1, wherein the first hub props against the second hub to align the first member with the second member.

18. The apparatus of claim 1, wherein the first hub tilts in a clockwise direction towards the second hub and wherein the second hub tilts in a counterclockwise direction towards the first hub.

19. The apparatus of claim 1, wherein the first member includes a first medium engaging portion, wherein the second member includes a second medium engaging portion, wherein the first hub asymmetrically extends from the first medium engaging portion and wherein the second hub asymmetrically extends from the second medium engaging portion into abutment with the first hub.

20. A method comprising:

engaging a medium with a first member rotatable about an axle and having a center of mass so as to lean in a first direction along the axle; and engaging the medium with a second member rotatable about the axle and having a center of mass so as to lean in a second opposite direction along the axle into abutment with the first member, wherein the first member and the second member each have a smallest interior diameter through which the axle extends and wherein the axle has an outer diameter at least 25% less than the smallest interior diameter.

21. The method of claim 20, wherein the first member and the second member each comprise a star wheel.

22. The method of claim 20 further comprising depositing a printing material upon a face of the medium, wherein the printing material upon the medium is engaged by the first member and the second member.

23. The method of claim 20, wherein the first member and the second member each include a medium engaging portion and a hub asymmetrically extending from the medium engaging portion.

24. A medium transport system comprising:

an axle;

a first means for engaging a medium while rotating about the axle and for leaning in a first direction along the axle; and a second means for engaging a medium while rotating about the axle and for leaning in a second opposite direction along the axle such that the first means and the second means lean into abutment with one another, wherein the first means and the second means each have a smallest interior diameter through which the axle extends and wherein the axle has an outer diameter at least 25% less than the smallest interior diameter.

* * * * *

UNITED STATES PATENT AND TRADEMARK OFFICE

CERTIFICATE OF CORRECTION

PATENT NO. : 7,955,013 B2
APPLICATION NO. : 11/553668
DATED : June 7, 2011
INVENTOR(S) : Hugo S. Ortiz It is certified that error appears in the above-identified patent and that said Letters Patent is hereby corrected as shown below:

In column 9, line 43, in Claim 1, delete “abut” and insert -- about --, therefor.

Signed and Sealed this
Tenth Day of January, 2012

David J. Kappos

David J. Kappos
*Director of the United States Patent and Trademark Office*